United States Patent [19]

Carey et al.

[11] 4,036,448

[45] July 19, 1977

[54] APPARATUS FOR FORMING SPOOLED AND SPOOL-LESS BUNDLES OF WIRE AND THE LIKE

[75] Inventors: Charles Henry Carey; Donald Richard Haury, both of Cuyahoga Falls, Ohio

[73] Assignee: Wean United, Inc., Pittsburgh, Pa.

[21] Appl. No.: 621,708

[22] Filed: Oct. 14, 1975

[51] Int. Cl.[2] ..... B21C 47/00

[52] U.S. Cl. ..... 242/81; 242/82

[58] Field of Search ..... 242/81, 82, 78, 78.1, 242/83

[56] References Cited

U.S. PATENT DOCUMENTS

| | | | |
|---|---|---|---|
| 2,044,574 | 6/1936 | Johnson | 242/81 X |
| 2,658,611 | 11/1953 | McIlvried | 242/78 X |
| 2,669,347 | 2/1954 | McIlvried | 242/78 X |
| 2,944,758 | 7/1960 | Wright | 242/83 |

*Primary Examiner*—Edward J. McCarthy
*Attorney, Agent, or Firm*—Daniel Patch

[57] ABSTRACT

The present disclosure relates, in combination with a draw block, to a continuous type takeup block and spooler and a stripper for employment in the manufacture of metal wire to form selectively spooled bundles or coiled bundles of wire. The combination consists of a gear-driven unit for internally driving a draw block having an upper supporting surface for alternately supporting for operation therewith a stripper or second block in the form of a continuous accumulating block from which wire is passed to a spooler; the latter being employed when spooled bundles are to be formed and the former, when spool-less bundles are desired.

5 Claims, 4 Drawing Figures

APPARATUS FOR FORMING SPOOLED AND SPOOL-LESS BUNDLES OF WIRE AND THE LIKE

As used heretofore and hereafter, the terminology used to refer to the basic machine components are those generally employed in the metal wire manufacturing industry as will be more evident from the prior art patents to be referred to later on.

In the manufacture of wirelike products, such as, for example, carbon steel wire, it has been the practice in the past to form the wire after drawing or processing, such as, galvanizing, into bundles of some predetermined weight. The form the bundles take may differ in that there is an industrial requirement both that the bundles be wound on a spool or without a spool. Conventionally, the spooless bundles are formed by a combined draw block and stripper mechanism; whereas, the spooled bundles are foremed by a continuous takeup block employed in combination with a draw block and a spooling apparatus. Heretofore, there has been no wire drawing and bundle forming apparatus for allowing a wire manufacturer to employ a single draw block and drive and, yet, form wire into either a spooled or spool-less bundle.

It is, accordingly, the object of the present invention to provide in combination with a wire drawing block or the like means that will allow the quick and easy mounting of either a stripper wire bundling forming device or a continuous takeup block; the latter being employed in conjunction with a spooling device.

More particularly, the present invention provides a wire-drawing block having a drive means for rotating the block, means associated with the block for rotatably supporting a stripper mechanism for forming in conjunction with the draw block spool-less bundles of wire, said means also adapted to alternately support a continuous takeup block which is employed in conjunction with the draw block and a spooler to form the spooled bundles of wire.

The objects, as well as other novel features and advantages of the present invention, will become apparent when the following description is read along with the accompanying drawings of which:

Figure 1:
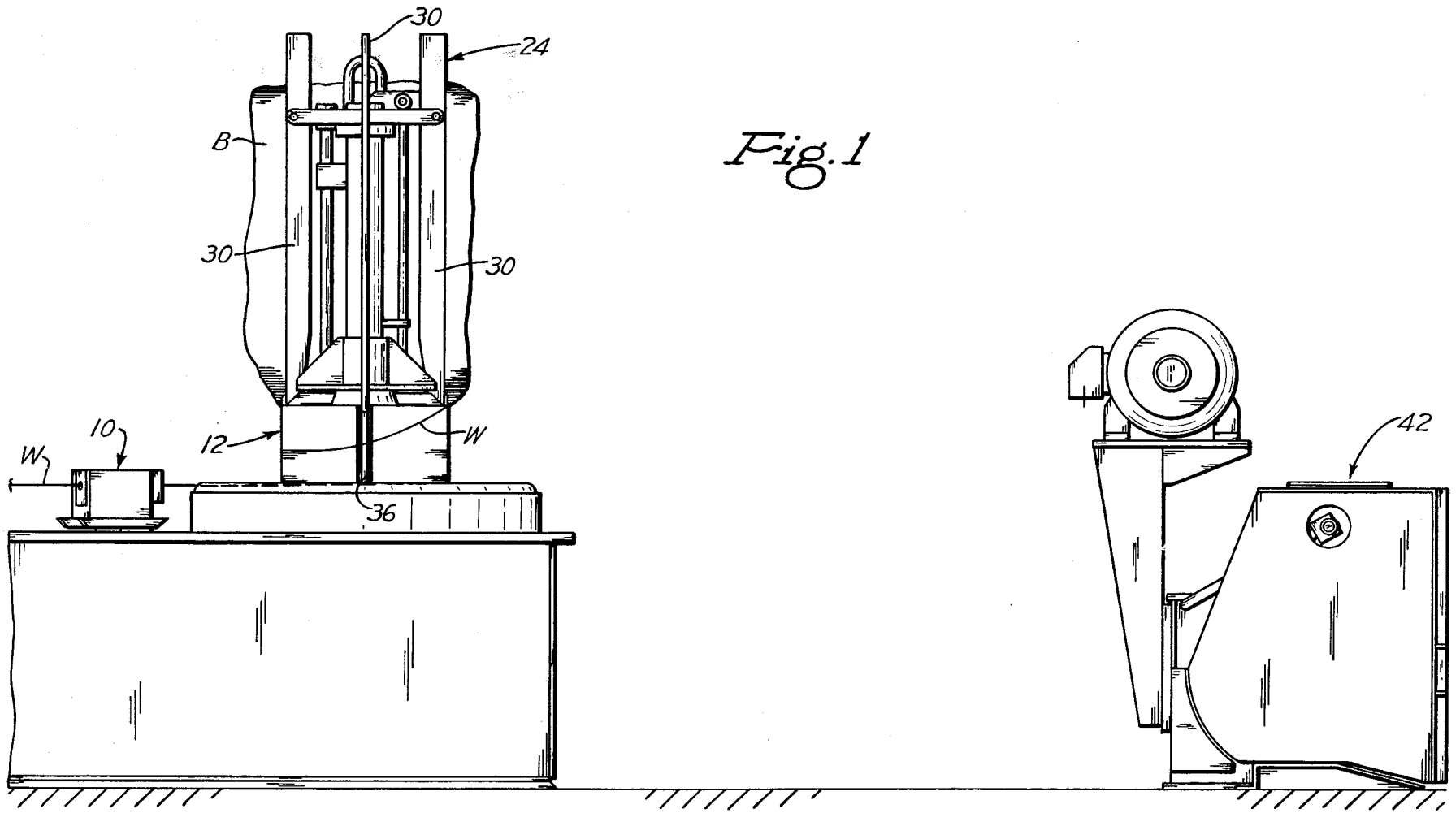
FIG. 1 is an elevational view of the present invention illustrating the combination of a draw block and stripper for forming spool-less bundles; a spooler being shown at the right of FIG. 1 being inoperative.

With reference first to FIG. 1, there is illustrated the last die holder assembly 10 of a wire drawing machine; the wire being identified at W passing to and from the assembly 10 from where the wire is received by a finishing draw block assembly 12. The die holder assembly and the finishing draw block assembly may follow several well-known forms, an example of one form of draw block is being shown, in part, in U.S. Pat. No. 2,669,347 dated Feb. 16, 1954. As shown in this patent and in FIGS. 2 and 3, the block assembly includes a drum 14 having a lower peripheral flange 16 securely mounted on a vertical shaft 18. The wire is tightly wound around the drum 14 in a manner to maintain a desired tension on the wire between the die assembly and the block and at the same time causing the wire to move upwardly on the drum to form part of the bundle and allowing the next convolution to be formed on the drum.

Figure 4:
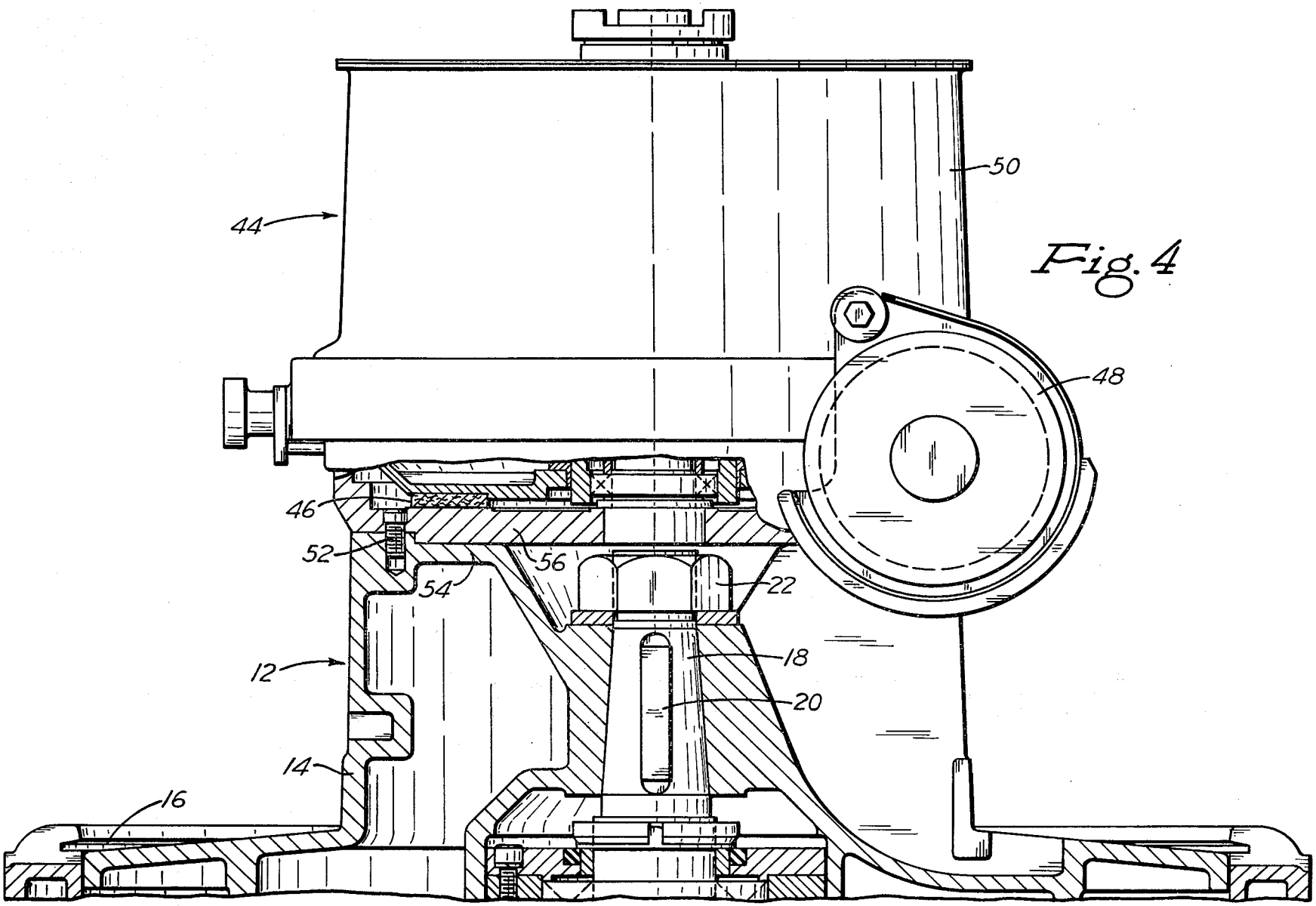
FIG. 4 is an enlarged view of the draw block and continuous takeup block illustrated in FIG. 2; a portion of the draw block and its drive being shown in section.

This vertical displacement of the convolution of wire can be accomplished in a number of well-known ways; one being to cause the flange 16 to rotate out of parallel to the horizontal. A portion of the drive assembly for the drum 14, and, more particularly, for the shaft 18 is shown in FIG. 4. The shaft 18 is secured to the drum 14 by a key 20 and a nut 22; a support for the shaft and a drum and the driving components may follow the arrangement illustrated in FIG. 1 of U.S. Pat No. 2,658,611 dated Nov. 10, 1953,where a worm-wheel gear arrangement is shown for driving the drum-supporting shaft 18. This patent also shows the inclined relationship of the flange 18 for causing each succeeding convolution of wire to move up the drum 14 to form the bundle.

Figure 3:
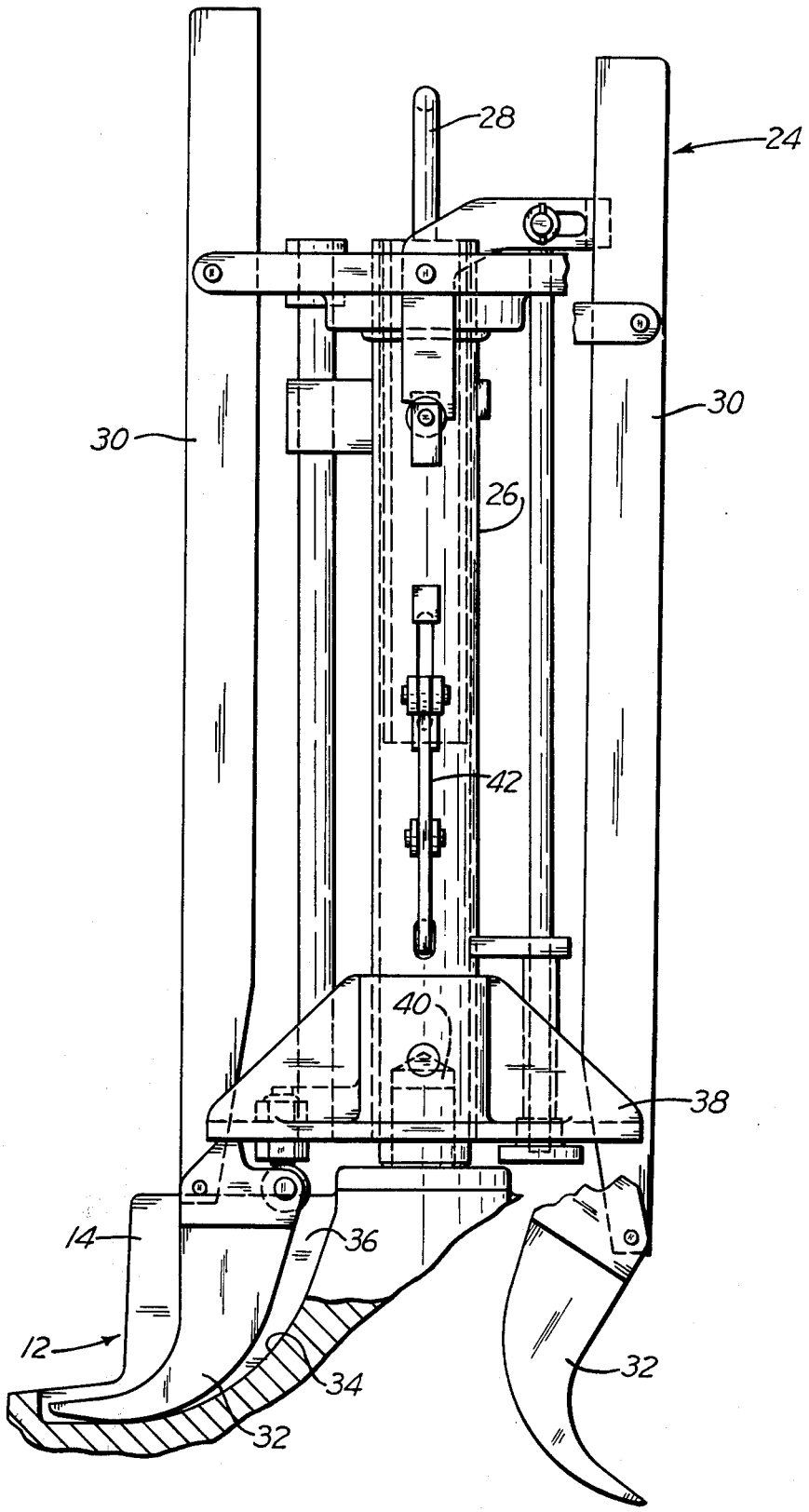
FIG. 3 is an enlarged view of the stripper mechanism shown in FIG. 1 and including a portion of the draw block shown in partial section.

As noted before, the arrangement of FIG. 1 is employed to form spool-less bundles; therefore, there is mounted on the draw block assembly 12 a stripper assembly 24. The stripper assembly can take several well-known forms and be either a non-collapsible or collapsing type; the latter being illustrated in the aforesaid U.S. Pat. No. 2,658,611. As best shown in FIG. 3 the stripper includes a central hollow post 26 that supports a clevis 28 for bringing the stripper assembly to and from the draw block 12 and four outside links 30; three being shown in FIG. 1. The links in an usual manner pivotally support feet 32 that are in unison collapsible as shown on the right of FIG. 3 or expandable as shown at the left of this figure. The particular movement of the feet 32 is caused by the inter-relationship of the vertical position of the links 30 and the contact between the feet and cooperative cam surfaces 34 formed internally in the drum 14. The links 30 actually are lowered into four slots 36 formed in the drum; one being shown in FIG. 1. The stripper at its lower end is provided with a bracket 38 which has a central hole for receiving a guiding pilot stem 40 The pilot stem is screwed on the threads provided on the shaft 18 at the top of the drum 14 after the nut 22, shown in FIG. 4 is removed. As in the arrangement shown in U.S. Pat. No. 2,658,611,the stripper is provided with a locking device 42 to prevent the unit from inadvertently loosening in the wire block when a complete bundle of spool-less wire has been formed on the stripper. On the other hand, the stripper assembly is brought to the draw block, the locking device releases the feet, allowing them to assume their collapsed position so that they may pass into the slots 36 of the drum 14.

To lift the stripper assembly off the draw block assembly 12 a hook is placed in the clevis 30 and the stripper with its bundle is removed vertically; the pilot stem 40 offering no resistance, serving only to guide the stripper into and out of the draw block assembly. FIG. 1 includes a partial showing of a bundle formed on the stripper assembly 24. To finish the description of FIG. 1, it needs to be noted that a spooler assembly 42, shown to the right and which will be described later, is not employed when the stripper assembly 24 is being used; the stripper being used only when it is desired to be formed spool-less type bundles of wire; whereas, the spooler assembly is employed to form spooled bundles.

With reference to the arrangement of FIGS. 2 and 4, there is again illustrated the last wire die assemblies 10 and the wire W passing to and from the assemblies to the finishing draw block assembly 12. This block does not now support a stripper assembly 24, but, instead, a continuous takeup block assembly 44. The assembly 44 may follow several well-known forms, such as, the form illustrated in the afore said U.S. Pat. No. 2,669,347. The takeup block need not include a positive and direct control to regulate the speed of the upper and lower blocks and can employ instead a friction member 46 interposed between the two blocks for allowing the lower block to drive the upper block in the same direction and allow the upper block to be stopped and held against rotation temporarily while a completed spool is being removed from the spooler 42. This arrangement is also referred to in the aforesaid U.S. Pat. No. 2,669, 347.

In any event, the draw block assembly 12 operates in the manner previously described and feeds wire to a sheave 48 from where the wire is fed to a drum 50 of the takeup block assembly 44 where it is continually accumulated even when a spooled bundle is in the course of being removed from the spooler 42. The wire on the drum 50 is wound in the opposite direction from the wire on the drum 14, but, as noted above, the two drums rotate in the same direction. This allows the drum 14 to form continuous convolutions of wire and to create a preset tension between the drum block 12 and the die assembly 10; whereas, the action of the sheave 48 and the drum 50 with reference to the reverse direction of the wire allows the uppermost convolution of wire on the drum 50 to be peeled off of the drum at a rate of speed substantially equal to the controllable revolutions per minute of the spooler 42 while allowing for a controllable tension to be maintained on the wire beween the takeup block and the spooler.

In view of the fact that the construction and operation of the takeup block assembly is well known, as exemplified in the aforesaid U.S. Pat. No. 2,669,347 patent, no further description is deemed necessary. It is important to describe, however, the means provided by the present invention for removing and replacing the takeup block 44 from the draw block 12 so that the block 44 or the stripper 24 can be quickly and easily interchanged. As noted above, the stripper 24 requires only the removal of the nut 22 and insertion of the pilot stem 40. To mount the takeup block 44 on the draw block 12, the top of the block 44 as shown in FIG. 4 is provided with several bolted holes for receiving bolts 52 that pass into matching threaded holes provided in the top adjacent supporting surface 54 of the draw block 12. The two contacting surfaces 54 of the lower blocks 12 and 50 of the upper drum 50 will rotate together; whereas, the upper drum 50 of the takeup block 44 will be driven by the friction member 46 in the same direction or remaining stationary depending on the operational phase of the bundle forming apparatus.

Figure 2:
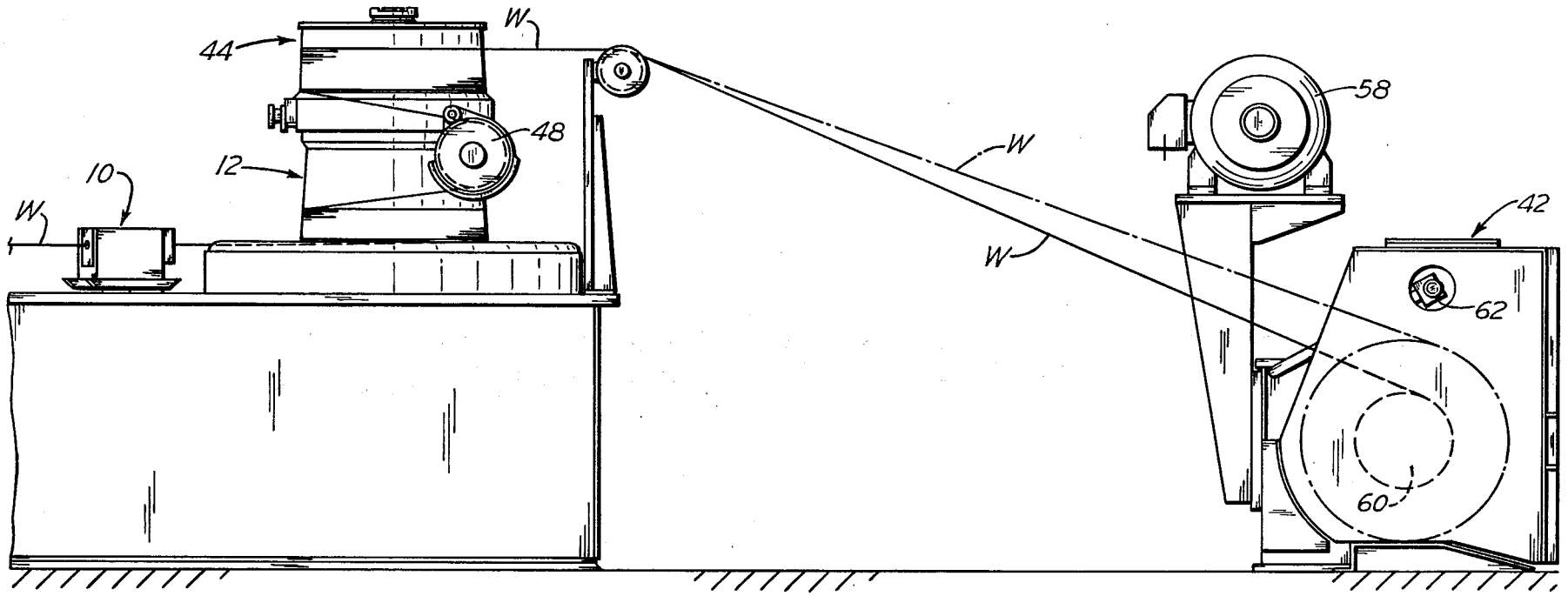
FIG. 2 is an elevational view of the present invention illustrating the combination of a draw block and a continuous takeup block from where wire is fed to the spooler where it is formed into a spooled bundle.

As shown in FIG. 2, the wire is fed from the upper portion of the takeup block 44 to the spooler FIG. 2 illustrates the wire hard line as it appears at the beginning of the spooling operation and in phantom line at the completion of the spooled bundle. The spooler 42 may take several well-known forms, such as, the one illustrated in U.S. Pat. No. 2,331,798 dated Oct. 12, 1943. In FIG. 2 there is diagrammatically shown a drive 58 for an arbor 60 on which a spool is maintained. Also shown is the wire traverse control assembly 62. In operating the apparatus to form spooled bundles, as noted previously, when the spool is completed and it is removed from the arbor 60, the takeup block 44 is stopped, thereby interrupting the travel of the wire to the spooler 42, but still allowing the wire to pass to the draw block 12 and be accumulated. The complete spool is removed from the arbor 60 by cutting the wire and an empty spool is then mounted in its place on the arbor. After this, the cut end of the wire associated with the takeup block is fed around the spool to commence the next operation.

In accordance with the provisions of the patent statutes, we have explained the principle and operation of our invention and have illustrated and described what we consider to represent the best embodiment thereof.

We claim:

1. An apparatus for selectively forming spool-less and spooled bundles of elongated material, such as, wire, comprising:

a draw block means for forming interconnecting convolutions of said material, means for rotating said block means so that the convolutions are formed under tension, material collecting means selectively employed for receiving material from said draw block means to form spool-less bundles of said material, said block means including means for supporting said collecting means for rotation with said drawing block means, material accumulating means selectively employed in place of said collecting means for receiving material from said draw block means to form spooled bundles of said material, said accumulating means including supportable by said draw block means, said accumulating means also including means for selectively allowing the accumulating means to rotate with said draw block means for allowing relative rotation therebetween, and spooling means for receiving said material from said accumulating means for forming said material into a spooled bundle.

2. An apparatus according to claim 1 wherein said material collecting means comprises a stripper assembly.

3. An apparatus according to claim 1 wherein said material accumulating means comprises a takeup block.

4. An apparatus according to claim 1 including quick connectable fastening means for securing said material accumulating means to said draw block means.

5. An apparatus according to claim 1 including quick connectable fastening means for securing said material collecting means to said draw block means.

* * * * *